US006855063B2

(12) United States Patent
Murphy et al.

(10) Patent No.: US 6,855,063 B2
(45) Date of Patent: Feb. 15, 2005

(54) ARBOR GUIDE SHOE ASSEMBLY FOR COUNTERWEIGHT SYSTEM

(75) Inventors: Michael S. Murphy, Baldwinsville, NY (US); Rodney F. Kaiser, Syracuse, NY (US)

(73) Assignee: J. R. Clancy, Inc., Syracuse, NY (US)

( * ) Notice: Subject to any disclaimer, the term of this patent is extended or adjusted under 35 U.S.C. 154(b) by 569 days.

(21) Appl. No.: 09/996,311

(22) Filed: Nov. 28, 2001

(65) Prior Publication Data

US 2003/0100412 A1 May 29, 2003

(51) Int. Cl.[7] ..... A63J 1/02
(52) U.S. Cl. ..... 472/78; 472/79; 16/93 R
(58) Field of Search ..... 472/75, 77–79; 160/339; 16/93 R, 94 R; 187/406; 482/98–103, 93, 94

(56) References Cited

U.S. PATENT DOCUMENTS 1,261,775 A * 4/1918 Curran et al. ..... 472/78
1,296,422 A * 3/1919 Morris ..... 472/78
2,142,063 A * 12/1938 Tompkins ..... 472/78
2,293,306 A * 8/1942 Pilcher ..... 16/93 R
2,727,272 A 12/1955 Hankin et al.
3,430,678 A * 3/1969 Barnes et al. ..... 16/93 R
3,466,802 A * 9/1969 Doveinis et al. ..... 16/93 R
3,466,803 A * 9/1969 Packett ..... 16/93 R
4,134,177 A 1/1979 Janson
4,606,540 A * 8/1986 Chin-Sen ..... 482/98
4,795,405 A 1/1989 Davis
4,829,630 A * 5/1989 Church et al. ..... 16/93 R
5,106,057 A 4/1992 Feller et al.
5,711,713 A 1/1998 Krueger
6,537,155 B2 * 3/2003 Steve et al. ..... 472/79

* cited by examiner

*Primary Examiner*—Justine R. Yu
*Assistant Examiner*—Victor Hwang
(74) *Attorney, Agent, or Firm*—Brian B. Shaw, Esq.; Stephen B Salai, Esq.; Harter, Secrest & Emery LLP

(57) ABSTRACT

An arbor guide shoe assembly for slidably interconnecting an arbor top plate or bottom plate with a pair of spaced rails. The guide shoe assembly has a rail contacting channel which defines a plurality of operable rail capturing distances, and an elongate slot for orienting the guide shoe assembly with a plurality of orientations with respect to the counterweight arbor.

18 Claims, 4 Drawing Sheets

FIG.2
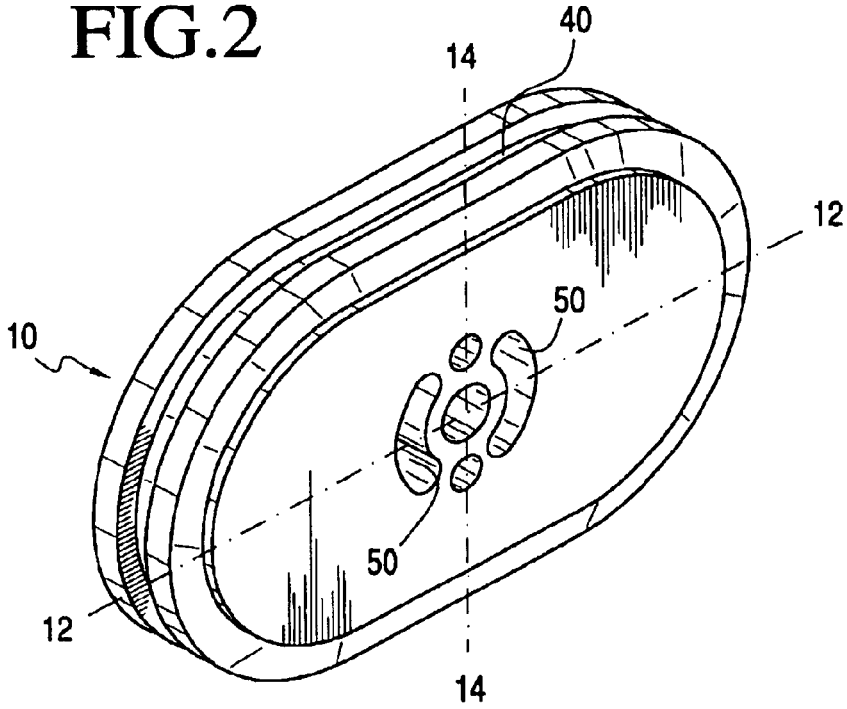
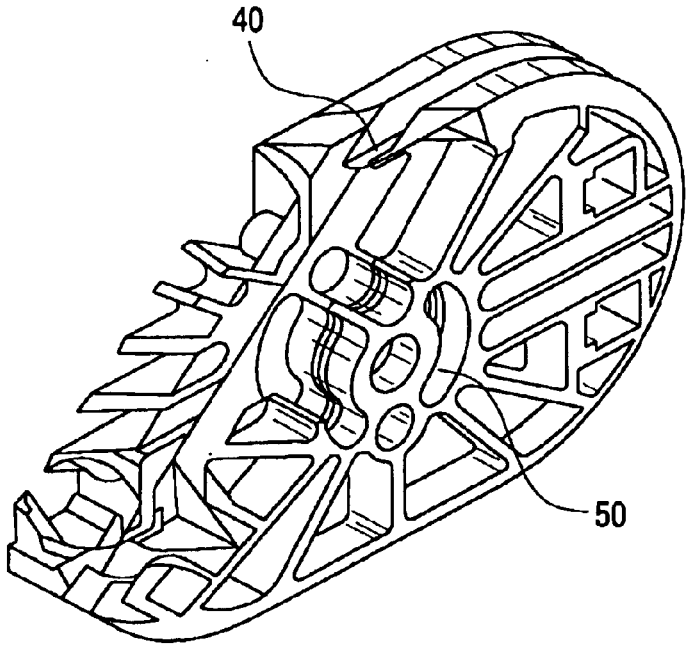
FIG.3

FIG.4
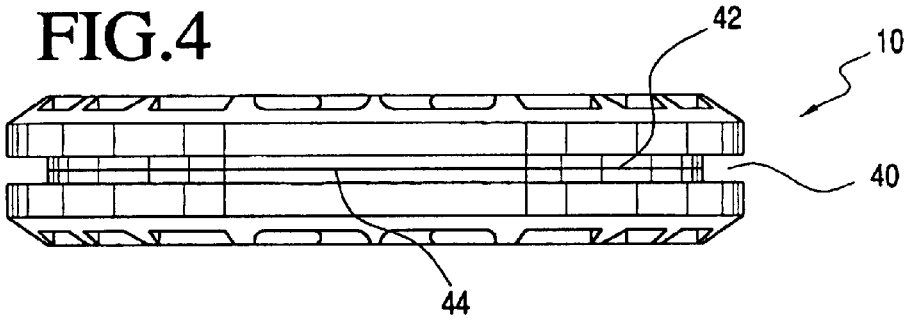
FIG.5
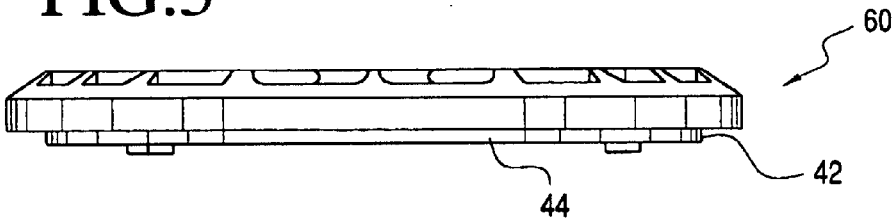
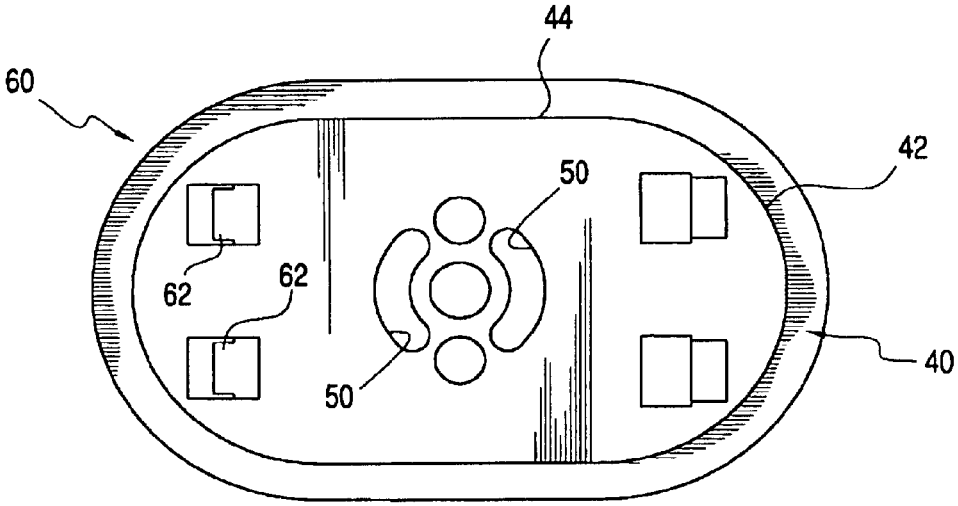
FIG.6
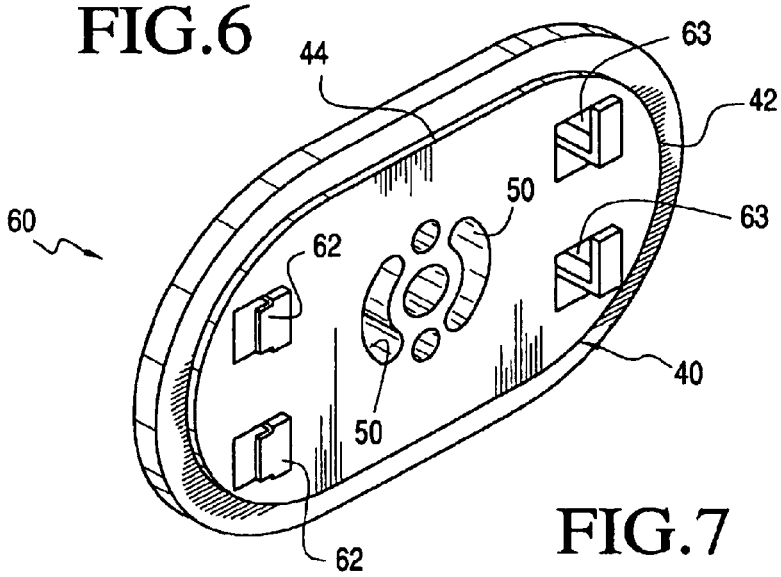
FIG.7

FIG.8
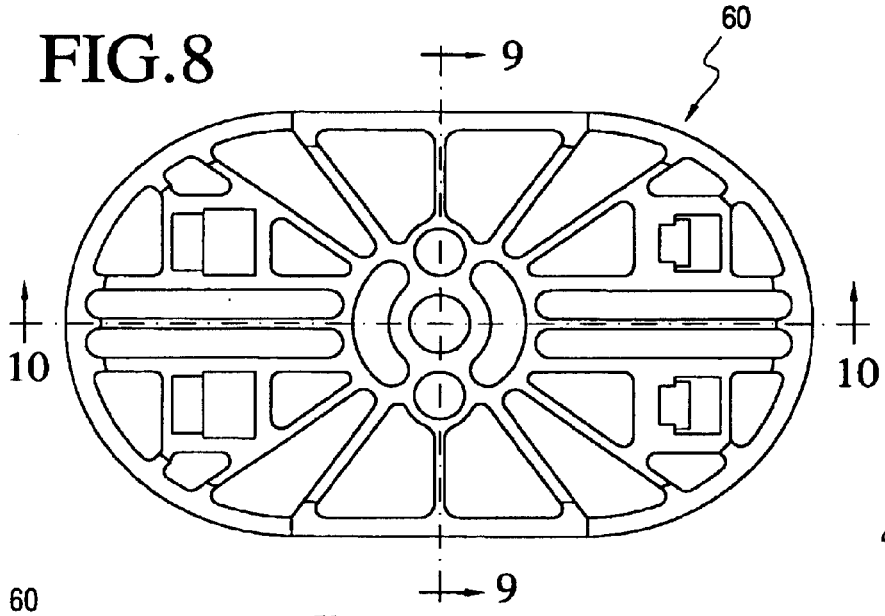
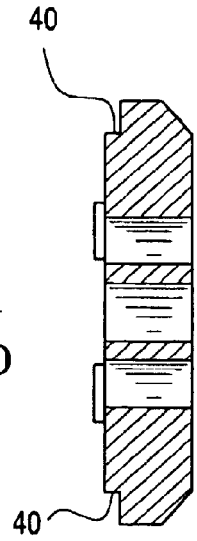
FIG.9
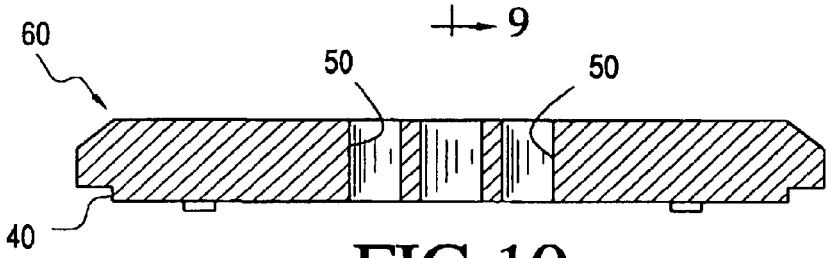
FIG.10
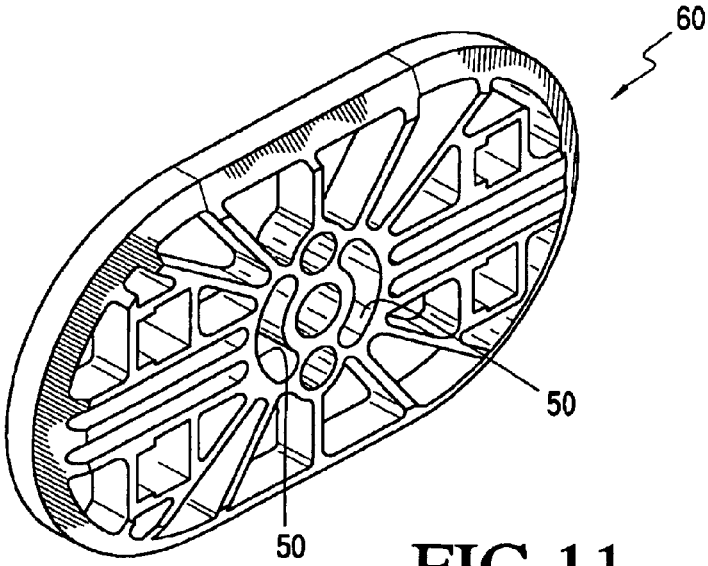
FIG.11

ARBOR GUIDE SHOE ASSEMBLY FOR COUNTERWEIGHT SYSTEM

FIELD OF THE INVENTION

The present invention relates to rigging systems including those for theaters, studios, concert halls, arenas, television studios, casino showrooms and cruise ships, and more particularly, to a counterweight arbor guide shoe assembly having a curvilinear rail contacting surface and elongated slots for operably engaging the guide shoe assembly and the counterweight arbor in a plurality of operable positions.

BACKGROUND OF THE INVENTION

Counterweight systems are often employed for balancing battens and loaded battens in a stage environment. In principal, the counterweight is set to generally match the combined load of the batten and any attached load, such as scenery, lighting or sound equipment. The counterweights are releasably connected to the counterweight arbors or carriages. The conventional counterweight arbor has a top and a bottom between which the weights are selectively disposed. The counterweight arbor (carriage) is slidably translated along vertically extending rails. The slidable interconnection of the counterweight arbor and the rails is accommodated by a multi component structure specifically sized for the specific spacing of the rails in a respective counterweight arbor.

However, the need exists for a counterweight arbor guide shoe assembly that can be utilized for a variety of rail spacings, without requiring separate construction of the guide shoes. The need further exists for a counterweight arbor guide shoe assembly that can be adjusted to accommodate tolerances derived from manufacture of the rail, the arbor or installation of the counterweight system.

SUMMARY OF THE INVENTION

The present invention provides a counterweight arbor guide shoe assembly for slidably interconnecting a counterweight arbor and a guide rail. The present guide shoe assembly can be disposed to accommodate guide rail systems having differing spacing between the guide rails. That is, the present guide shoe assembly can be utilized in rail systems having six, eight or tern inch centers, as well as intermediate spacings.

In a first configuration, the guide shoe assembly includes a guide shoe having a curvilinear rail bearing surface and a curvilinear arbor mounting slot. In one construction, the counterweight arbor includes a pair of mounting apertures or pins disposed along an inclined line. The corresponding mounting slots in the guide shoe assembly are selected to allow the guide shoe assembly to be mounted relative to the counterweight arbor at a plurality of orientations. Preferably, the guide shoe assembly can be operably connected to the counterweight arbor at and between 90° orientations.

In a further configuration, the guide shoe assembly is constructed of a pair of identical interlocking guide plates, wherein the guide plate includes a pair of arbor mounting slots and a curvilinear rail contacting surface.

BRIEF DESCRIPTION OF THE DRAWINGS

FIG. 2 is a perspective view of a guide shoe assembly.

FIG. 3 is a partial cutaway of perspective view of a guide shoe assembly showing structural features.

FIG. 4 is a top plan view of a guide shoe assembly.

FIG. 5 is a top plan view of a guide plate.

FIG. 6 is a side elevational view of the inside surface of a guide plate.

FIG. 7 is a perspective view of the inside surface of a guide plate.

FIG. 8 is a side elevational view of the outside surface of a guide plate.

FIG. 9 is a cross sectional view taken along lines 9-9 of FIG. 8.

FIG. 10 is a cross sectional view taken along lines 10-10 of FIG. 8.

FIG. 11 is a perspective view of the outside surface of a guide plate.

DETAILED DESCRIPTION OF THE PREFERRED EMBODIMENT

Figure 1:
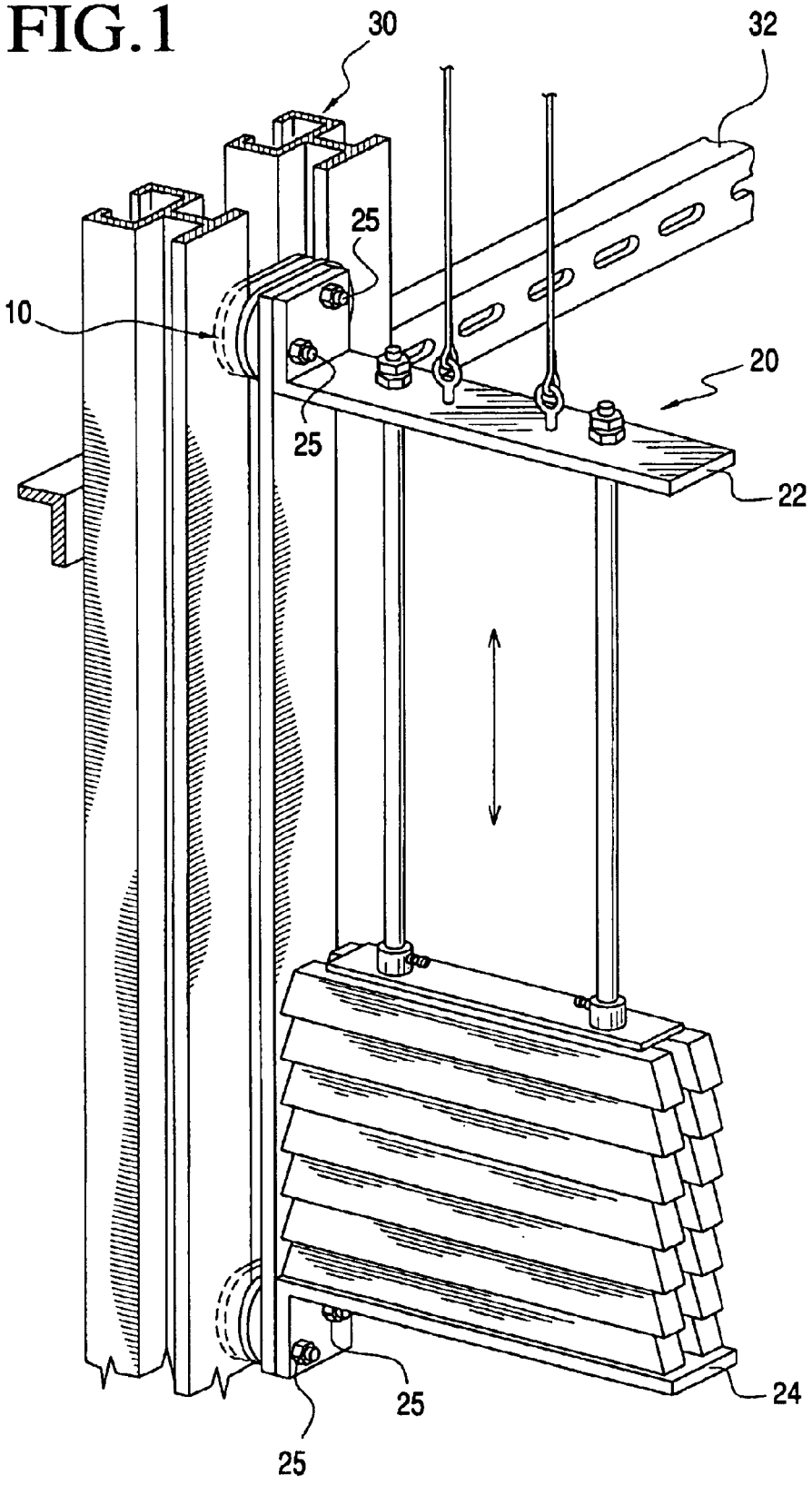
FIG. 1 is a perspective view of a counterweight arbor assembly employing the present guide shoe assembly.

Referring to FIG. 1, the guide shoe assembly 10 of the present invention is employed in a counterweighted rigging system, such as a stage or theater rigging. However, the invention is independent of the specific location or application of the rigging system. The rigging system usually includes a plurality of variable counterweights for balancing loads attached to corresponding battens, wherein the battens are to be raised and lowered relative to a stage.

The counterweight system includes a plurality of counterweight arbors 20 that are raised and lowered along corresponding vertical rails or flanges 30. The counterweight arbor usually includes or are connected to an arbor guide for guiding the counterweight arbor relative to the rails. The counterweight arbor 20 includes an arbor top 22 and an arbor bottom 24. Preferably, each of the arbor top 22 and the arbor bottom 24 include a pair of mounting apertures 25 for operable alignment with the guide shoe assembly 10. In previous systems, the arbor top 22 and arbor bottom 24 included a single mounting hole to engage fastener for coupling to the guide shoe. In some systems, two vertically aligned mounting holes. While such mounting holes can be accommodated in the present invention, one configuration employs the mounting holes 25 of the arbor top 22 and the arbor bottom 24 disposed along a line inclined 45° from vertical.

Typically, the rails 30 are spaced at predetermined intervals along a wall 32 or frame to which the counterweight system is attached. Typical spacings of the rails 30 are 6, 8 or 10 inch centers. However, within a system spacing of a given distance, installation and manufacturing tolerances result in variances along the length of the rails 30. Although the term rail 30 is used the description, it encompasses flanges along which the counterweight arbor 20 is to be guided.

The rail 30 can be any of a variety of configurations and typically includes the projecting flange for engaging the arbor guide assembly. Thus, the rail 30 may have a variety of cross sectional profiles including L, T, U, I, H, C and still employ the present invention.

The guide shoe assembly 10 operably interconnects the counterweight arbor 20 and a rail 30. Preferably, the guide shoe assembly 10 engages a pair of consecutive spaced apart rails 30 and the counterweight arbor 20.

The guide shoe assembly 10 includes a rail contacting surface 40 and an arbor mounting slot 50. The guide shoe assembly 10 defines a major axis 12 extending along a longer dimension of the assembly and a transverse minor axis 14 extending along a lesser coplanar dimension. As shown in FIG. 2, the major axis 12 and the minor axis 14 intersect at a central point of the guide shoe assembly 10.

Although the guide shoe assembly 10 is shown as having a generally obround periphery, it is understood the rail contacting surface 40 can be a circular arc, a portion of an ellipse, hyperbola or other curvilinear segment.

The rail contacting surface 40 defines that portion of the guide shoe assembly 10 that engages the rails 30 to retain and guide the counterweight arbor 20 relative to the rails. The rail contacting surface 40 preferably defines channel that can contact three sides of the rail 30 such as the front, the exposed edge and the back. The rail contacting surface 40 can have any of a variety of cross sections such as C, U or even V shaped. It is desired the channel have a sufficient depth (that the legs of the cross sectional profile have a sufficient length) to accommodate tolerances and variations within a given rail system spacing.

The rail contacting surface 40 defines a rail capture distance, or span that is the distance between any two points that are diametrically opposed across the center of the guide shoe assembly. As the rail contacting surface 40 is curvilinear, the rail capture distance depends upon the orientation of the guide shoe assembly 10 relative to the counterweight arbor 20 and the rail 30.

The rail contacting surface 40 is selected such that as the guide shoe assembly 10 is rotated relative to the counterweight arbor 20 (and the rails 30), the horizontal distance between the extremes of the rail contacting surfaces is varied. That is, as the guide shoe assembly 10 is rotated relative to the counterweight arbor and the rails, the rail capture distance varies. Thus, as the guide shoe assembly 10 is disposed with the major axis horizontal, the rail contacting surface 40 spans the greatest rail capture distance. In contrast, as the guide shoe assembly 10 is disposed to locate the minor axis horizontal, the rail contacting surface 40 defines a minimum rail capture distance. Preferably, the spanned distance of the rail contacting surfaces 40 continuously varies from the maximum distance along the major axis to a minimum distance along the minor axis. However, it is understood the spanned distance can vary incrementally rather than continuously, wherein the increments are selected to operably engage any of a variety of rail spacings. That is, preferably, the rail contacting surface 40 is curvilinear or sufficiently multi-faceted to permit a plurality of operable orientations of the guide shoe assembly relative to the rails.

As shown, the present rail contacting surface 40 defines a generally obround profile. That is, the rail contacting surface 40 has a curvilinear section 42 and a straight section 44. In one configuration, the section of the rail contacting surface 40 extending between the maximum rail capture distance and the minimum rail capture distance is curvilinear, or sufficiently faceted to allow a discrete stepwise function that accommodates the anticipated tolerances in the rail system. In the configuration of FIGS. 1–3, as the guide shoe assembly 10 is disposed with the major axis being horizontal, the portion of the rail contacting surface 40 which contacts the rails 30 is curvilinear. In contrast, as the guide shoe assembly 10 is disposed with the minor axis being horizontal, the portion of the rail contacting surface 40 engaging the rails 30 is substantially straight, wherein the intermediate orientations of the guide shoe assembly expose a curvilinear (or incrementally faceted) rail contacting surface to the rails.

However, it is understood these are predominately design choices and so long as the arbor guide assembly has rail contacting surfaces 40 which can be operably located at the desired spacing by rotation of the guide shoe assembly 10 relative to the arbor top plate 22 or arbor bottom plate 24, the rail contacting surface can be thus selected.

Referring to FIGS. 2, 3, 6 and 7, the guide shoe assembly 10 includes a pair of arbor mounting slots 50. The arbor mounting slots 50 are selected to allow the guide shoe assembly 10 to rotate relative to the counterweight arbor 20 and the rails 30. It is this rotation that allows varying the rail capture distance presented by the guide shoe assembly 10.

Preferably the arbor mounting slots 50 are arcuate and define an approximately 90° arc, thus allowing the guide shoe assembly 10 to rotate between presenting the maximum rail capture distance to the minimum rail capture distance. However, it is understood the rotation of the guide shoe assembly 10 can be accomplished with a pivot point and a single slot, or other equivalent structures.

In a preferred configuration, the guide shoe assembly 10 is formed of a pair of identical interlocking guide plates 60. Although the guide shoe assembly 10 is shown as a pair of interlocking guide plates 60, it is understood the guide shoe assembly can be formed of a single piece of material. In alternative configurations, the guide plates can be uniquely formed. The benefit of identical guide plates 60 is reduction in inventory requirements and manufacturing considerations.

The guide plate 60 includes the arbor mounting slot 50 and a part of the rail contacting surface 40. Referring to FIGS. 1-4, the guide plate 60 defines one leg of a U shaped rail contacting channel and a portion of the closed end of the rail contacting channel. The fully defined channel cross section is formed upon the engagement of two guide plates 60.

Operable engagement of a pair of guide plates 60 is provided by interlocking tabs and recesses. In one configuration, the guide plate 60 includes a spaced apart tab 62 and slot 63 for receiving a corresponding guide plate 60 in an interlocking manner. Preferably, the guide plate 60 includes a pair of tabs 62 and a pair of spaced apart slots 63. The tabs 62 and slots 63 are symmetrically located on the guide plate 60 to allow two identical guide plates 60 to interlock.

It is understood that any of a variety of interlocking mechanisms can be employed, such as snap fits and friction fits. Further, the guide plates 60 may be temporarily retained by manual retention prior to operable engagement with the counterweight arbor 20.

Although the guide shoe assembly 10 is shown as formed of identical interlocking guide plates 60, it is understood that one of the guide plates can include or define the rail contacting surface, such as the channel and the remaining plate serve as forming the shoulder upon operable engagement with the first plate. Thus, the guide's plates can be unique.

Any of a variety of interconnecting mechanisms can be used to interconnect the guide shoe assembly 10 and the arbor top 22, and the arbor bottom 24. The interconnecting mechanisms include, but are not limited to screws, threads, bolts, rods, or pins. For purposes of simplicity and description, the configuration employing a bolt for is disclosed.

In contrast to prior systems, which employ a single bolt for interconnecting the arbor top plate 22 and the guide shoe assembly 10, and the arbor bottom plate 24 and the guide shoe assembly, the present arbor top plate 22 and arbor bottom plate 24 includes a pair of mounting apertures located along an inclined line. Preferably, the mounting apertures lie upon a line 45° from vertical and horizontal. The arbor mounting slots 50 are selected to operably align with the corresponding mounting apertures in the arbor top plate 22 and the arbor bottom plate 24.

Installation and Operation

To operably interconnect to the counterweight arbor 20 and the rail 30, a pair of guide plates 60 is interlocked by engaging the corresponding tabs 62 and slots 63. The guide shoe assembly 10 is then rotated to be dispose the rail contacting channel 40 between opposing rails 30. The guide shoe assembly 10 is then rotated in the opposite direction to contact or abut the rail contacting surface 40 with the corresponding portion of the rail 30. The guide shoe assembly 10 can be disposed with the major axis 12 being horizontal or vertical, or any orientation therebetween (assuming the rail contacting surface is continuous—it is understood if the rail contacting surface is multi-faceted, there will be discrete orientations intermediate the horizontal and vertical disposition of the major axis).

Upon the guide shoe assembly 10 being rotated to operably dispose a portion of the rails 30 within the rail contacting channel and contact the rail contacting surface, mounting bolts are passed through the arbor mounting slots 50 in the guide plates 60 and into the corresponding offset apertures in the arbor top plate 22, or arbor bottom plate 24, and tightened to thus locate the guide shoe assembly 10 relative to the counterweight arbor 20 and rail 30.

While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

We claim:

1. A guide shoe assembly for slidably interconnecting a counterweight arbor and a rail, comprising:

(a) a guide shoe having a curvilinear rail capturing and receiving channel and an elongate arbor mounting slot.

2. The guide shoe assembly of claim 1, further comprising a linear rail capturing and receiving channel.

3. The guide shoe assembly of claim 1, wherein the rail capturing and receiving channel has a U shaped cross section.

4. The guide shoe assembly of claim 1, wherein the rail capturing and receiving channel defines one of an obround and elliptical periphery of the guide shoe assembly.

5. The guide shoe assembly of claim 1, wherein the elongate arbor mounting slot is arcuate.

6. The guide shoe assembly of claim 1, further comprising a second elongate arbor mounting slot.

7. A guide shoe assembly for slidably interconnecting a counterweight arbor and a rail, comprising:

(a) a guide shoe having a plurality of rail bearing and receiving surfaces and an elongate arbor mounting slot.

8. The guide shoe assembly of claim 7, wherein the rail bearing and receiving surface is curvilinear.

9. The guide shoe assembly of claim 7, wherein the elongate arbor mounting slot is curvilinear.

10. The guide shoe assembly of claim 7, wherein the rail contacting and receiving surface has a channel shaped cross section.

11. A guide shoe assembly for slidably interconnecting a counterweight arbor and a rail, comprising:

(a) a first mating guide plate; and (b) a second mating guide plate selected to interconnect with the first mating guide plate to form a guide shoe, the guide shoe including a plurality of rail contacting and receiving surfaces and an elongate arbor mounting slot.

12. The guide shoe assembly of claim 11, wherein the elongate arbor mounting slot is curvilinear.

13. The guide shoe assembly of claim 11, further comprising a second elongate arbor mounting slot.

14. The guide shoe assembly of claim 13, wherein the elongate arbor mounting slot and the second elongate arbor mounting slot are symmetrically located in the guide shoe.

15. The guide shoe assembly of claim 11, wherein the first mating guide plate and the second mating guide plate are identical.

16. An arbor guide shoe assembly for operably engaging a counterweight arbor and slidably engaging a rail, comprising:

(a) a pair of interlocking plates, the plates defining a rail contacting and receiving channel and at least on of the one of the plates including an elongate arbor mounting slot for operably aligning the one of the plates and the counterweight arbor in a plurality of orientations.

17. The arbor guide shoe assembly of claim 16, wherein the interlocking plates are identical.

18. An arbor guide shoe assembly for interconnection with a rail and a counterweight arbor, the guide shoe assembly and the arbor being interconnected by a fastener, the assembly comprising:

(a) a guide shoe having a rail contacting and receiving channel defining a plurality of rail spacings and an elongate fastener slot for operably engaging the guide shoe relative to the arbor in a plurality of positions.

* * * * *